US008156671B2

(12) United States Patent
Presley et al.

(10) Patent No.: US 8,156,671 B2
(45) Date of Patent: Apr. 17, 2012

(54) PHOTOLUMINESCENT EXIT DEVICE

(75) Inventors: John Presley, Monroe, NC (US); Mike Ott, Matthews, NC (US); Blue Houser, Edgemoor, SC (US); Tony Kirby, Knoxville, TN (US); Tom Harris, Charlotte, NC (US)

(73) Assignee: Yale Security Inc., Monroe, NC (US)

( * ) Notice: Subject to any disclaimer, the term of this patent is extended or adjusted under 35 U.S.C. 154(b) by 2050 days.

(21) Appl. No.: 10/904,231

(22) Filed: Oct. 29, 2004

(65) Prior Publication Data

US 2006/0096141 A1 May 11, 2006

(51) Int. Cl.
*G09F 13/04* (2006.01)

(52) U.S. Cl. ..... 40/542; 40/661.12; 362/100; 292/93

(58) Field of Classification Search ..... 40/544, 40/542, 599, 549, 661.12; 292/92, 93; 362/100
See application file for complete search history.

(56) References Cited

U.S. PATENT DOCUMENTS

| | | | | |
|---|---|---|---|---|
| 1,898,505 | A * | 2/1933 | Soemer | 292/92 |
| 2,341,583 | A | 2/1944 | Tuve | |
| 4,385,586 | A | 5/1983 | Schriever | |
| 4,401,050 | A | 8/1983 | Britt et al. | |
| 4,420,898 | A | 12/1983 | Moses | |
| 4,466,208 | A | 8/1984 | Logan, Jr. et al. | |
| 4,754,266 | A | 6/1988 | Shand et al. | |
| 4,914,554 | A | 4/1990 | Sowers | |
| 5,008,551 | A | 4/1991 | Randolph | |
| 5,130,909 | A | 7/1992 | Gross | |
| 5,169,185 | A * | 12/1992 | Slaybaugh et al. | 292/92 |
| 5,240,647 | A | 8/1993 | Ashley et al. | |
| 5,724,909 | A | 3/1998 | Pitman et al. | |
| 5,775,016 | A | 7/1998 | Chien | |
| 5,904,017 | A | 5/1999 | Glatz et al. | |
| 6,237,266 | B1 | 5/2001 | Tassey et al. | |
| 6,276,634 | B1 | 8/2001 | Bodle | |
| 6,280,654 | B1 | 8/2001 | Digman et al. | |
| 6,307,207 | B1 | 10/2001 | Burbank | |

(Continued)

FOREIGN PATENT DOCUMENTS

CA 2460508 9/2005

(Continued)

OTHER PUBLICATIONS

Yale Security, Inc., International Patent Application No. PCT/US2005/039136; International Preliminary Report on Patentability, dated Mar. 19, 2009.

(Continued)

*Primary Examiner* — Casandra Davis
(74) *Attorney, Agent, or Firm* — Michael G. Johnston; Moore & Van Allen PLLC

(57) ABSTRACT

A photoluminescent member is provided for an exit device. The photoluminescent member comprises a housing member for mounting to the exterior surface of the exit device. The housing member includes a photoluminescent portion for being energized by exposure to an ambient light source and operable to automatically emit visible light photoluminescently for a substantial period of time in low ambient light or dark conditions and without being energized by an electrical current so that the photoluminescent portion provides illumination to identify the exit device in the low ambient light or dark conditions for providing a visual cue directing a person to a location of the exit device.

7 Claims, 3 Drawing Sheets

U.S. PATENT DOCUMENTS

| | | | | |
|---|---|---|---|---|
| 6,349,984 | B1 * | 2/2002 | Marrazzo et al. | 292/336.3 |
| 6,358,563 | B1 | 3/2002 | Van Duynhoven | |
| 6,461,012 | B1 | 10/2002 | Shuman | |
| 6,534,427 | B1 | 3/2003 | Quemere | |
| 6,699,598 | B2 | 3/2004 | Bretschneider et al. | |
| 6,715,225 | B1 | 4/2004 | Frolov et al. | |
| 7,204,050 | B2 * | 4/2007 | Molokotos et al. | 40/570 |
| 2002/0015309 | A1 | 2/2002 | Stokes et al. | |
| 2002/0132135 | A1 | 9/2002 | Sturley | |
| 2004/0070195 | A1 | 4/2004 | Nelson et al. | |
| 2004/0135122 | A1 | 7/2004 | Hyland, Jr. et al. | |
| 2005/0144822 | A1 | 7/2005 | Molokotos et al. | |
| 2006/0046093 | A1 * | 3/2006 | Landry et al. | 428/690 |
| 2006/0267356 | A1 * | 11/2006 | Catalano | 292/336.3 |
| 2007/0222626 | A1 * | 9/2007 | Picard et al. | 340/584 |

FOREIGN PATENT DOCUMENTS

| | | | |
|---|---|---|---|
| DE | 3200694 | | 7/1983 |
| GB | 2328064 | A * | 2/1999 |
| JP | 10037544 | A * | 2/1998 |

OTHER PUBLICATIONS

Yale Security Inc., International Patent Application No. PCT/US05/39136, International Search Report and Written Opinion, dated Aug. 21, 2008.

Yale Security Inc. Canada Application No. 2,586,025, filed Oct. 28, 2005, Office Action dated Mar. 19, 2010.

* cited by examiner

PHOTOLUMINESCENT EXIT DEVICE

BACKGROUND

The present invention relates to exit devices, and more particularly to exit devices that are visible in low light or dark conditions.

An exit device is a manual or electronic door operating mechanism operated from the inside of a door. A conventional exit device generally includes a frame or housing secured across a door face and substantially spanning the width of the door. A touch bar is movably mounted to the frame. The touch bar is mechanically linked to a latch mechanism, including a door latch which is movably mounted in the frame adjacent to a free edge of the door. Manually depressing the touch bar in the frame toward the door translates the mechanical linkage for actuating the latch mechanism in order to retract the door latch so that the door can be opened allowing egress.

During low light or dark conditions, such as during a power failure, or in an emergency, it is important to those within the building to quickly identify building exit doors. Commercial buildings are required to have signs identifying exits as well as directional or warning signage, which indicate to building occupants a path for leaving the building in low light or dark conditions. A pathway marking system may include passive lighting, which does not require a power source, to demarcate the outlines or sections of buildings structures such as stair risers, intersections of walls and floor, sloped ramps, doorways, hallways, or the location of handrails, and the like. Some passive pathway marking systems utilize photoluminescent materials which provide low level light as they discharge their stored energy. Photoluminescent materials contain inorganic phosphorus and pigments that absorb ambient light. In darkness, the photoluminescent material produces a sustained visible yellow-green, red or blue glow which provides sufficient illumination for guiding someone out of a darkened area. Examples of photoluminescent materials include zinc sulfide and alkaline metal oxide aluminates, such as calcium sulfide and strontium sulfide.

Unfortunately, passive marking systems have not been applied to exit devices. Electroluminescent exit devices are available. However, an electroluminescent exit device requires electricity with battery back-up power, and includes electrical wiring which extends through the exit device, the door and one of the door hinges for connection to a source of power.

For the foregoing reasons, there is a need for a photoluminescent exit device which is visible in low light or dark conditions for directing an occupant to a point of egress of a room or a building. The new exit device should ideally function effectively as a passive lighting device in a pathway marking

SUMMARY

According to the present invention, a photoluminescent member is provided for an exit device, the photoluminescent member comprising a housing member for mounting to the exterior surface of the exit device, the housing member including a photoluminescent portion for being energized by exposure to an ambient light source and operable to automatically emit visible light photoluminescently for a substantial period of time in low ambient light or dark conditions and without being energized by an electrical current so that the photoluminescent portion provides illumination to identify the exit device in the low ambient light or dark conditions for providing a visual cue directing a person to a location of the exit device.

Also according to the present invention, an exit device is provided comprising a frame for attachment to a surface of the door, a door latch mechanism mounted to the frame, the door latch mechanism including a latch bolt movable relative to the frame from an extended position to a retracted position. Means for actuating the exit device are movably mounted to the frame and operatively connected to the latch mechanism for moving the latch bolt from the extended position to the retracted position when pressure is applied to the actuating means for opening the door. A photoluminescent member is mounted to the frame, the photoluminescent member including a portion for being energized by exposure to an ambient light source and operable to automatically emit visible light photoluminescently for a substantial period of time in low ambient light or dark conditions and without being energized by an electrical current so that the photoluminescent member provides illumination to identify the exit device in the low ambient light or dark conditions for providing a visual cue directing a person to a location of the exit device.

Further according to the present invention, a combination including a door pivotally mounted along one edge to a door frame and an exit device is provided. The exit device comprises a housing adapted to be secured to the door surface and a latch bolt disposed at one end of the housing adjacent an edge of the door and movable relative to the housing between a projected position extending outwardly of the housing for securing the door relative to the frame in a closed position and a retracted position where the latch bolt is inside the housing for allowing the door to be opened. An actuator is movably supported on the housing for movement relative to the housing from a first position to a second position and operatively connected to the latch mechanism for moving the latch from the extended position to the retracted position when pressure is applied to the actuator for opening the door in response to movement of the actuator toward the second position of the actuator. A photoluminescent member is disposed on the housing, the photoluminescent member being energized by exposure to an ambient light source and operable to automatically emit visible light photoluminescently for a substantial period of time in low ambient light or dark conditions and without being energized by an electrical current. The photoluminescent member provides illumination to identify the exit device in the low ambient light or dark conditions for providing a visual cue directing a person to a location of the exit device and the door.

Still further according to the present invention, a system is provided for indicating the direction of an exit route for use in a building including a door through which a person will move in following the exit route. The system comprises a door pivotally mounted along one edge to a door frame and an exit device. The exit device comprises a housing adapted to be secured to the door surface and a latch bolt disposed at one end of the housing adjacent an edge of the door and movable relative to the housing between a projected position extending outwardly of the housing for securing the door relative to the frame in a closed position and a retracted position where the latch bolt is inside the housing for allowing the door to be opened. An actuator is movably supported on the housing for movement relative to the housing form a first position to a second position and operatively connected to the latch mechanism for moving the latch from the extended position to the retracted position when pressure is applied to the actuating means is pushed for opening the door in response to movement of the actuator member toward the second position of the actuator member. A photoluminescent member is disposed on the housing, the photoluminescent member being energized by exposure to an ambient light source and operable to automatically emit visible light photoluminescently for a substantial period of time in low ambient light or dark conditions and without being energized by an electrical current. The photoluminescent member provides illumination to identify the exit device in the low ambient light or dark conditions for providing a visual cue directing a person to a location of the exit device.

BRIEF DESCRIPTION OF THE DRAWINGS

For a more complete understanding of the present invention, reference should now be had to the embodiments shown in the accompanying drawings and described below. In the drawings.

DESCRIPTION

The present invention provides a photoluminescent exit device that is visible in low light or dark conditions. The exit device according to the present invention is for use in commercial applications and the photoluminescent feature may be adapted for use with any conventional exit device such as, for example, the exit devices described by U.S. Pat. No. 4,796,931; U.S. Pat. No. 5,042,851; U.S. Pat. No. 5,605,362 and U.S. Pat. No. 5,816,017, the contents of all of which are hereby incorporated by reference. Accordingly, detailed explanations of the functioning of all of the exit device components are deemed unnecessary for understanding the present invention by one of ordinary skill in the art.

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Figure 1:
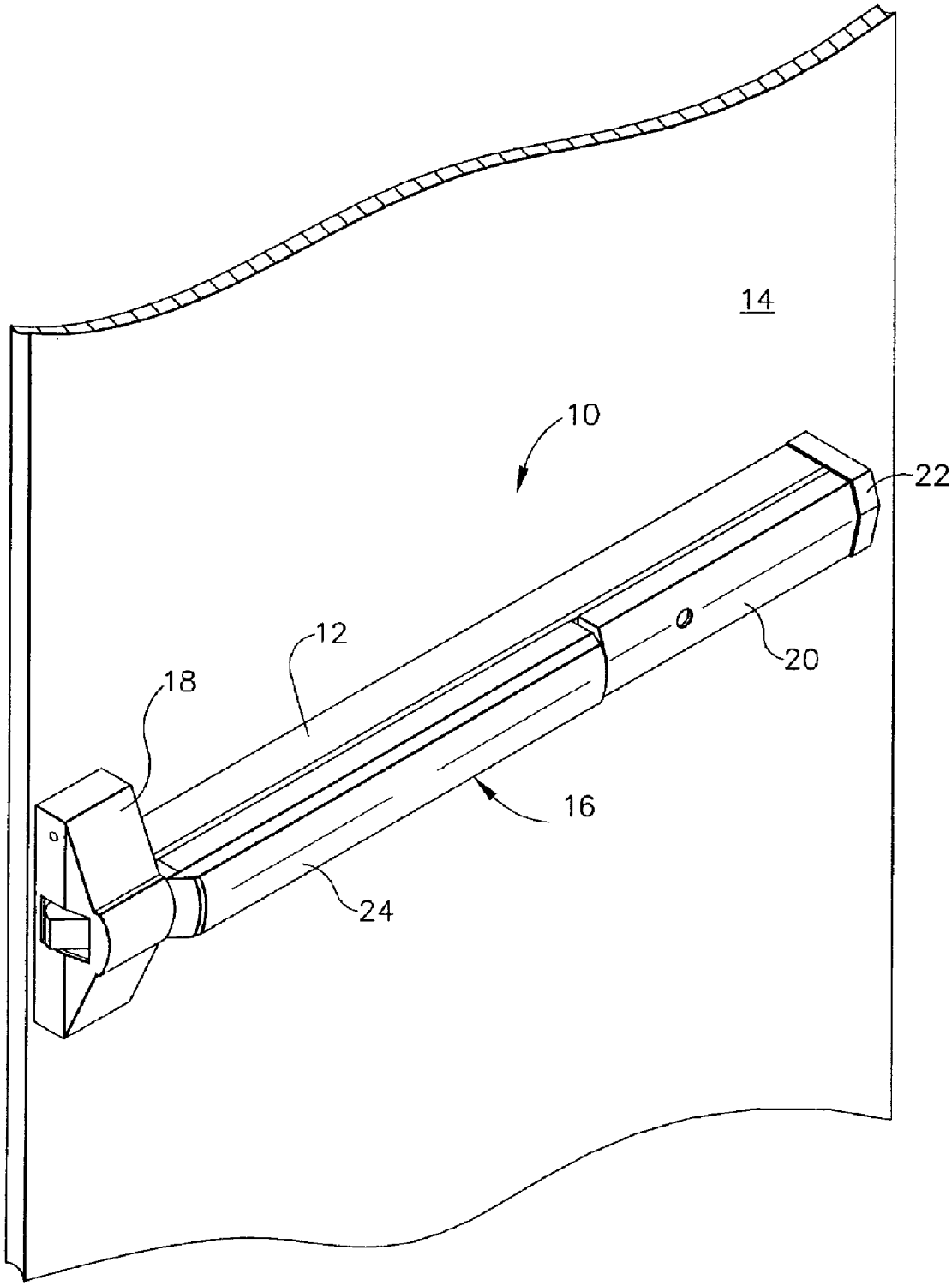
FIG. 1 is a perspective view of an exit device according to the present invention mounted on a door.

Referring now to the drawings, wherein like reference numerals designate corresponding or similar elements throughout several views, FIG. 1 shows an exit device according to the present invention mounted to a door to be secured and generally designated at 10. The exit device 10 includes an elongated frame 12 that is mounted at a horizontal position across the interior surface of the door 14. The housing 12 comprises a touch bar 16, a latch housing 18 at one end and a cover plate 20 having an end cap 22 at the other end. The touch bar 16 longitudinally spans a substantial portion of the housing 12 and defines a surface 24 for receiving a manual pushing force exerted toward the door 14 by a person attempting to egress through the door.

According to the present invention, at least a portion of the exit device 10 includes photoluminescent material which provides a light source in low light or dark conditions. In one embodiment of the present invention, the portion of the exit device 10 that comprises photoluminescent material is the touch bar 16.

Figure 2:
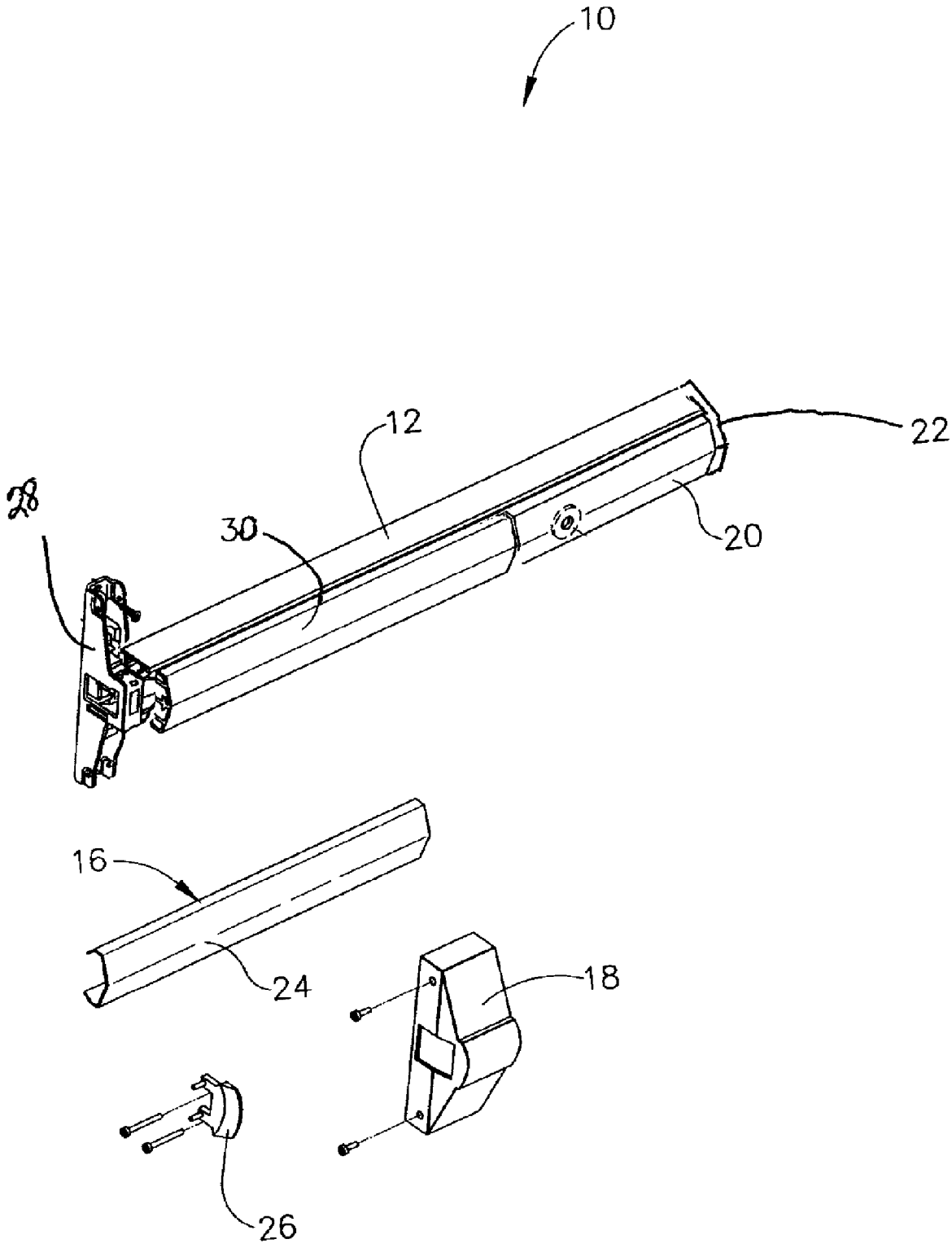
FIG. 2 is an exploded perspective view of the exit device shown in FIG. 1 with a latch cover, end plate and touch bar removed.

Referring to FIG. 2, the latch housing 18, touch bar 16, and a front end cap 26 are shown separate from the remaining components of the exit device 10. A door latch mechanism 28 and an actuator 30 are visible. The latch mechanism 28 may be of the type illustrated, or it may be a concealed or visible vertical rod type, or any other type of latch mechanism known in the art. The actuator 30 is movably mounted in the frame 12 and operably connected to the latch mechanism 28. When manual pushing force is applied to the actuator 30 through the touch bar 16, the latch mechanism 28 is operated allowing opening of the door 14. It is understood that the actuator 30 may be a pushbar, push rail, push plate or other type of exit device actuator known in the art.

Figure 3:
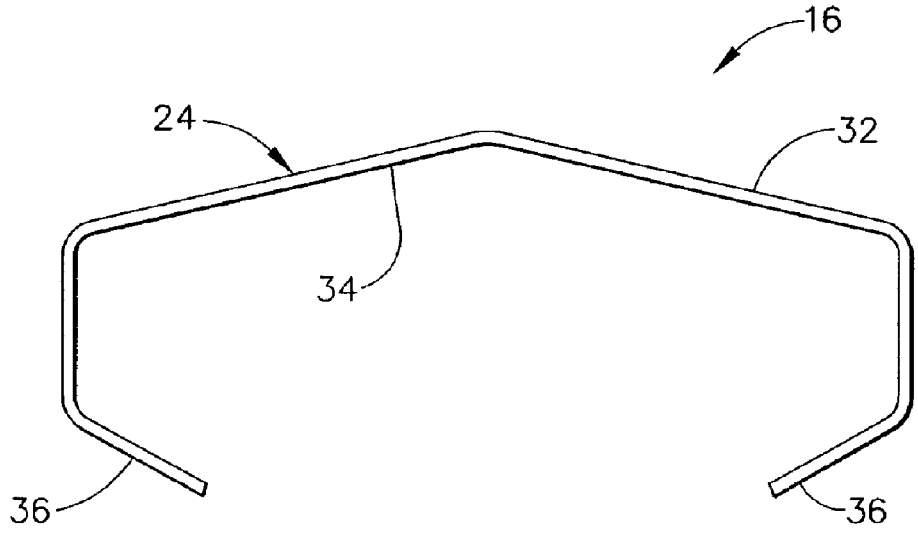
FIG. 3 is a longitudinal cross section of the touch bar shown in FIG. 2.

Referring to FIG. 3, the touch bar 16 comprises a solid, generally C-shaped body having a front surface 32 and a back surface 34. The body of the touch bar 16 terminates in opposed in-turned flanges 36 which cooperate to define a receiving track. The cross-section of the touch bar 16 is designed to correspond to the cross-section of the actuator 30 and the receiving track is dimensioned for receiving the upper and lower edges of the actuator 30. With this configuration, when the latch housing 18 and the front end cap 26 removed (FIG. 2), the touch bar 16 may be slipped lengthwise over the actuator 30 for releasably coupling the touch bar 16 to the actuator 30 and the exit device 10 structure. It is understood that such removable attachment of the touch bar 16 to the exit device 10 simplifies repair and allows retrofit of the photoluminescent touch bar 16 to an exit device which has a conventional touch bar.

In the one embodiment of the present invention, the front surface 32 of the touch bar 16 includes a photoluminescent material. The photoluminescent material can be applied to the front surface 32 of the touch bar 16 using a coating composition which includes a photoluminescent pigment. A suitable photoluminescent material is available from Luna Technologies International, Inc., of Kent, Wash., sold under the trade name LUNAplast™, and comprises a strontium aluminate formulation. This strontium aluminate formulation is described in published international patent application number WO 99/27294, entitled "Photoluminescent Light Emitter with Enhanced Photometric Brightness Characteristics," published Jun. 3, 1999, the contents of which are hereby incorporated by reference. In a preferred embodiment, a stainless steel touch bar 16 is first cleaned and coated with a white epoxy enamel paint. After curing, the touch bar 16 is then coated with a proprietary powder product. The powder product is a TGIC polyester specially blended powder material. The touch bar 16 is then cured.

It is understood that many alternatives are available for rendering photoluminescence to the touch bar 16, or any other component of the exit device 10. For example, photoluminescent material is commercially available as an acrylic water-based paint, a tape, and in vinyl strips for application on a substrate. In addition, commercially available phosphorescent powders can be mixed with a suitable carrier to produce a paste that can be applied to the substrate. The tape or a strip of photoluminescent material may be affixed to the front surface 32 of the touch bar 16 with an adhesive such that the photoluminescent material overlays the touch bar 16. Moreover, although the strontium aluminate is described above as a preferred photoluminescent material, zinc sulfide or other alkaline metal oxide aluminate-based photoluminescent material can also be used. In addition, it is understood that many alternatives for rendering photoluminescence to the exit device 10, or any component of the exit device. The touch bar 16 is preferred, but is only one example. The most important feature is that the photoluminescent component provides visibility to an occupant of a building.

Alternatively, a photoluminescent material may be mixed with a formable structural material for producing a unitary product used a component of an exit device 10, such as the touch bar 16. In this embodiment, the touch bar 16 can be manufactured by an extrusion or molding process from rubber, vinyl, and the like, to name a few suitable materials. A hard, durable plastic is another example, such as an acrylic plastic or a polyethylene plastic. The selected material should be impact resistant. Other selection criteria for the material include expected life, cost and suitability for use as a component of an exit device. Photoluminescent dyes or particles of a photoluminescent material may be dispensed in the structural material prior to forming. Because the composition has been formed together, the photoluminescent material is spread throughout the depth of the touch bar 16 and the glow is emitted by the photoluminescent dye or particles within the body of the touch bar.

An exit device 10 with a photoluminescent touch bar 16 according to the present invention is visible in low light or dark conditions. The photoluminescent exit device 10 emits light for an appreciable time allowing an occupant to locate the exit device 10 and door 14. The building occupant is thus directed to the exit device 10 by the glow of the touch bar 16. Moreover, the touch bar 16 also provides a visual directional cue, signaling the location of the door and exit device 10 and the location of the actuator 30 for the exit device 10. When the building occupant room needs to exit the building, the occupant applies pressure to the illuminated touch bar 16 thereby opening the door 14 for egress. Further, the exit device 10 may function as a part of an emergency egress indication system including the exit device 10, signage, directional indicator stripes, doorway markings, stairway and lighting indication and the like.

Figure 4:
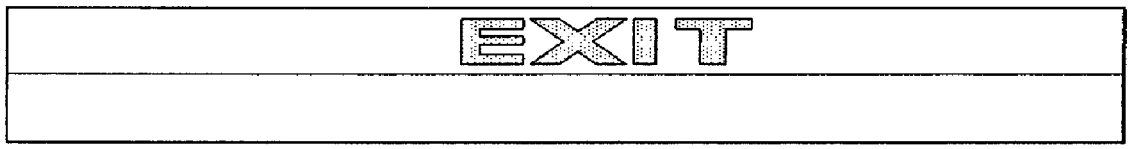
FIG. 4 is a front elevation view of a touch bar with the word "EXIT" for use with the exit device according to the present invention.

A graphic, such as a sign or display may be included on the front surface 32 of the touch bar 16. As shown in FIG. 4, the word "EXIT" is mounted directly on the touch bar 16. Other words, such as "EMERGENCY" or "EMERGENCY EXIT", or symbols may be employed, such as an arrow or other indicia (not shown). The sign can be applied using an opaque material laid over the photoluminescent material, such as an opaque film adhesively attached to the touch bar 16 thereby masking out the emitted light. An opaque paint or dye may also be applied to the touch bar. This leaves essentially dark marking portions for blocking illumination from the light emitting background. Alternatively, the touch bar or other background can be blacked out, letting the sign glow in the dark. The opaque portions may form the lettering of the sign or the area around the lettering. Alternatively, dyes, stains, and inks can be applied over the photoluminescent material. The dyes, stains, or inks glow in the dark with a different color than that of the photoluminescent layer. Thus, the both the background and the markings emit light. The sign and photoluminescent background form a sign assembly visibly mounted on the exit device.

Other alternatives are possible in keeping with the present invention. For example, a layer of reflective material may be provided on top of the photoluminescent portion of the exit device. The reflective material will also act as a light source and also reflect light. Preferably, the layer of reflective material is transparent in addition to being reflective. This will allow light emitted from the photoluminescent material to pass through the reflective layer.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, any component of the exterior of the exit device could be rendered photoluminescent. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A system for indicating the direction of an exit route for use in a building including a door through which a person will move in following the exit route, the system comprising a door pivotally mounted along one edge to a door frame; and an exit device, comprising a housing adapted to be secured to the door surface, a latch mechanism disposed at one end of the housing adjacent an edge of the door and movable relative to the housing between a projected position extending outwardly of the housing for securing the door relative to the frame in a closed position and a retracted position for allowing the door to be opened, an actuator movably supported on the housing for movement relative to the housing from a first position to a second position and operatively connected to the latch mechanism for moving the latch mechanism from the projected position to the retracted position when pressure is applied to the actuator for opening the door in response to movement of the actuator toward the second position of the actuator, a touch bar comprising a base portion terminating in longitudinal edges, planar legs extending from the longitudinal edges of the base portion and terminating in longitudinal edges, the legs extending the length of the base portion such that the base portion and the legs define an open longitudinal channel, and a flange integral with the longitudinal edges of each leg, each flange extending inwardly from the legs and terminating in longitudinal edges, and a photoluminescent material integral with the touch bar, the photoluminescent material being energized by exposure to an ambient light source and operable to automatically emit visible light photoluminescently for a substantial period of time in low ambient light or dark conditions and without being energized by an electrical current, wherein the photoluminescent material provides illumination to identify the exit device in the low ambient light or dark conditions for providing a visual cue directing a person to a location of the exit device, wherein the transverse cross-section of the touch bar corresponds to the transverse cross-section of the actuator such that the touch bar comprises a cover for the actuator.

2. The system for indicating the direction of an exit route as recited in claim 1, further comprising a sign including an opaque material for blocking illumination from the photoluminescent material, wherein the sign is visibly mounted on the touch bar over the photoluminescent material.

3. The system for indicating the direction of an exit route as recited in claim 2, wherein the sign includes openings for configuring the light emitted by the photoluminescent material for forming a message.

4. The system for indicating the direction of an exit route as recited in claim 3, wherein the message displays the word "EXIT".

5. The system for indicating the direction of an exit route as recited in claim 1, wherein the photoluminescent material is mixed with a formable structural material.

6. The system for indicating the direction of an exit route as recited in claim 1, wherein the photoluminescent material is selected from the group consisting of dyes and particles.

7. The system for indicating the direction of an exit route as recited in claim 1, wherein the touch bar is removable without removal of the exit device from the door to permit replacement or repair of the touch bar.

* * * * *